US005358427A

United States Patent [19]

Miwa

[11] Patent Number: 5,358,427

[45] Date of Patent: Oct. 25, 1994

[54] CONNECTOR HAVING A DUAL TERMINAL-FASTENING STRUCTURE

[75] Inventor: Takeya Miwa, Shizuoka, Japan

[73] Assignee: Yazaki Corporation, Tokyo, Japan

[21] Appl. No.: 197,554

[22] Filed: Feb. 17, 1994

Related U.S. Application Data

[63] Continuation of Ser. No. 939,717, Sep. 2, 1992, abandoned.

[30] Foreign Application Priority Data

Sep. 4, 1991 [JP] Japan ..... 3-070813[U]

[51] Int. Cl.[5] ..... H01R 13/436

[52] U.S. Cl. ..... 439/595; 439/752

[58] Field of Search ..... 439/594, 752

[56] References Cited

U.S. PATENT DOCUMENTS

| | | | |
|---|---|---|---|
| 4,867,712 | 9/1989 | Kato et al. | 439/752 |
| 4,946,399 | 8/1990 | Kawashima | 439/752 |
| 5,066,252 | 11/1991 | Kato et al. | 439/752 |
| 5,108,319 | 4/1992 | Tsuji et al. | 439/595 |
| 5,186,657 | 2/1993 | Abe | 439/595 |
| 5,203,722 | 4/1993 | Kinoshita | 439/595 |
| 5,224,883 | 7/1993 | Yamamoto | 439/595 |

FOREIGN PATENT DOCUMENTS

3834210A1 4/1989 Fed. Rep. of Germany .

*Primary Examiner*—Gary F. Paumen

*Attorney, Agent, or Firm*—Armstrong, Westerman, Hattori, McLeland & Naughton

[57] ABSTRACT

A connector has a dual terminal-fastening structure. Terminals each have an engagement hole and a engagement strap. The terminals are housed in terminal chamber formed in a housing. The terminal chamber has a support portion, which projects from the inner wall of the terminal chamber into the terminal chamber. The support portion supports a resilient fastening arm at an intermediate portion thereof. The resilient fastening arm extends within the chamber in a direction in which the terminal is inserted into the housing. The elongated resilient engagement arm has a first end portion and a second end portion. The second end portion engages the engagement hole of the terminal to hold the terminal within the terminal chamber. The housing is fitted into a terminal-fastener so as to fasten the terminals in place within the terminal chambers. The terminal-fastener is provided with first engagement portions and second engagement portions. The first engagement portion engages the engagement strap of the terminal to fasten the terminal within the terminal chamber when the terminal-fastener is fitted into the housing. The second engagement portion engages the inner wall of the terminal chamber, the support portion, and the first end portion of the fastening arm when the terminal-fastener is fitted into the housing.

8 Claims, 8 Drawing Sheets

CONNECTOR HAVING A DUAL TERMINAL-FASTENING STRUCTURE

This application is a continuation of application Ser. No. 07/939,717 filed Sep. 2, 1992, now abandoned.

BACKGROUND OF THE INVENTION

1. Field of the Invention

The present invention relates to a connector having a dual terminal-fastening structure where a terminal ms not only caught by a resilient terminal-engaging arm formed within a terminal chamber but also by a terminal fastener fitted into the terminal chamber.

2. Prior Art

FIGS. 7A and 7B show a prior art connector having a dual terminal-fastening structure.

A housing a is formed with an upper row and a lower row of terminal chambers b therein. Each of the terminal chambers has a resilient fastening arm d that prevents a terminal in the chamber from moving out of the chambers in the direction opposite to the direction in which the terminal is inserted. This resilient fastening arm d is usually quite limited in physical dimension because the connector is miniaturized and a large number of terminals are housed in the connector. The fastening arm d tends to have less terminal-fastening effect. Thus, a terminal fastener e is provided to increase terminal-fastening effect. The upper wall of the housing a is formed with a window f1 therein and the partition wall a2 is formed with a window f2 therein. The windows f1 and f2 are aligned with each other as shown in FIG. 7A. FIG. 7B shows a terminal fastener e being inserted into the housing a. The terminal fastener e is inserted into the housing a so that the engagement portion e1 of the terminal-fastener e engages a shoulder c1 of a terminal c, as shown in FIG. 7B, cooperating with the resilient fastening arm d to effect dual fastening.

The prior art dual fastening structure shown in FIG. 7 requires a hole, i.e., the window f2 in the partition a2 through which the terminal-fastener e is inserted. Thus, the wall cannot rigidly support the support portion d1 of the resilient fastening arm. Thus, the resilient fastening arm is often subjected to a tensile stress due to tensile forces exerted on the wires crimped to the terminals. This tensile stress results in damages to the support portion d1, losing one of the terminal-fastening effects.

SUMMARY OF THE INVENTION

The present invention was made in view of the aforementioned problems and provides a connector having a dual terminal-fastening structure that prevents damage to the resilient terminal-fastening arm as well as provides sure terminal-fastening effect.

Terminals each have an engagement hole and a pair of engagement straps. The terminals are housed in a terminal chamber formed in a housing. The terminal chamber has a support portion, which projects from the inner wall of the terminal chamber into the terminal chamber. The support portion supports a resilient fastening arm at an intermediate portion thereof. The resilient fastening arm extends within the chamber in a direction in which the terminal is inserted into the housing. The elongated resilient engagement arm has a first end portion and a second end portion. The second end portion engages the engagement hole of the terminal to hold the terminal within the terminal chamber. The housing is fitted into a terminal-fastener so as to fasten the terminals in place within the terminal chambers. The terminal-fastener is provided with first engagement portions and second engagement portions. The first engagement portion engages the engagement strap of the terminal to fasten the terminal within the terminal chamber when the terminal-fastener is fitted into the housing. The second engagement portion engages the inner wall of the terminal chamber, the support portion, and the first end portion of the fastening arm when the terminal-fastener is fitted into the housing.

BRIEF DESCRIPTION OF THE DRAWINGS

Features and other objects of the invention will be more apparent from the description of the preferred embodiments with reference to the accompanying drawings in which.

DETAILED DESCRIPTION OF PREFERRED EMBODIMENTS

Construction

Figure 1:
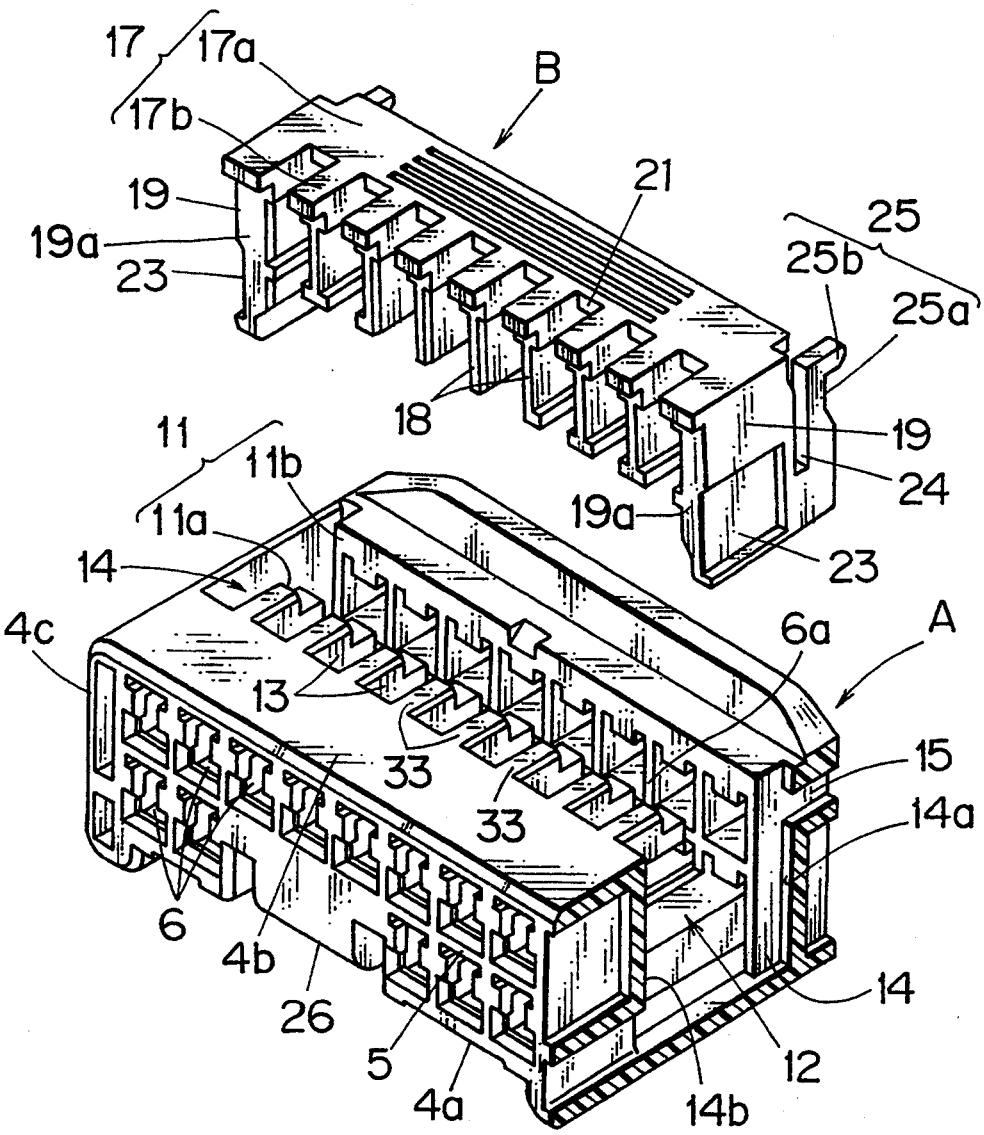
FIG. 1 is an exploded perspective view of a connector according to the present invention, showing a housing A and a terminal-fastener B.
Figure 2:
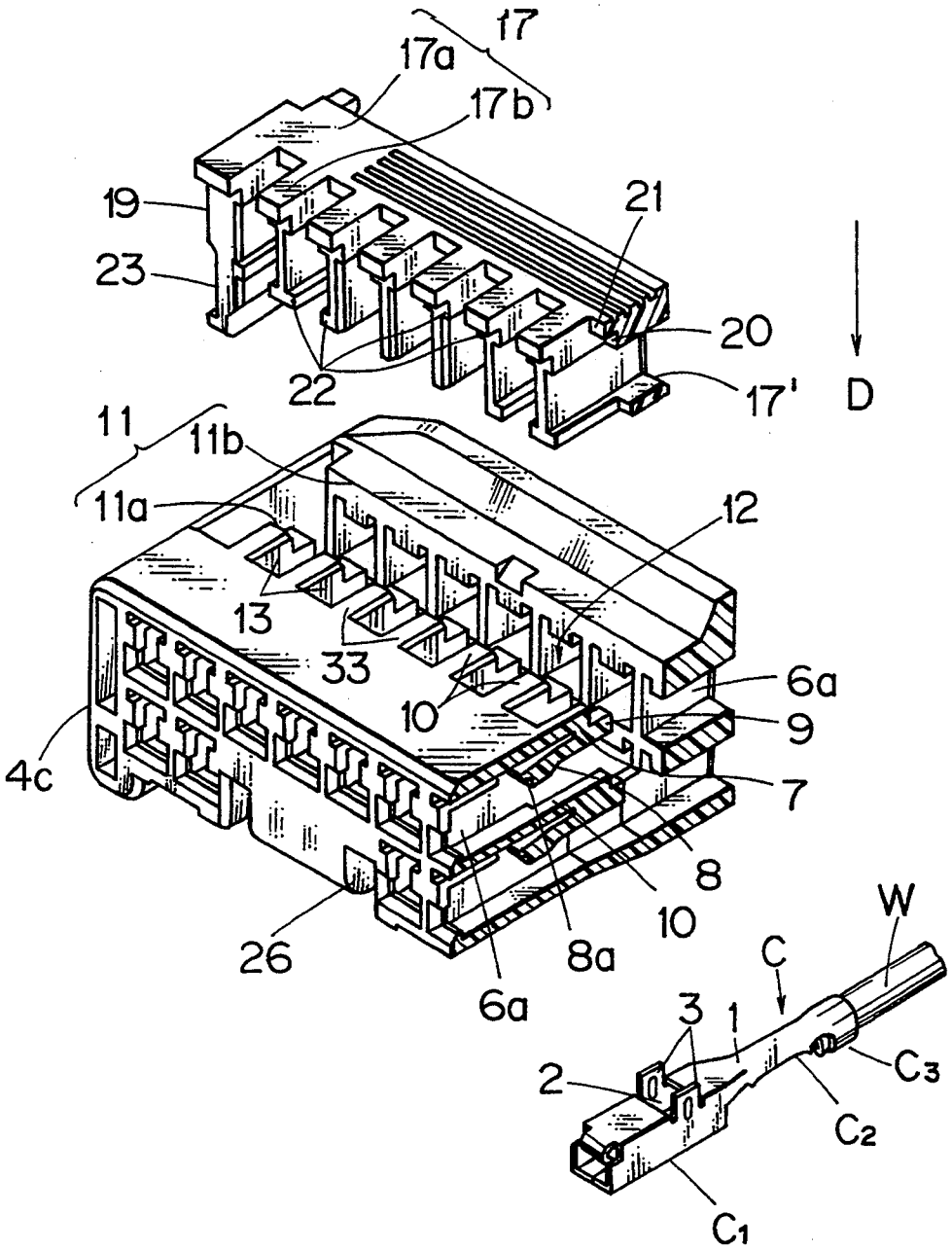
FIG. 2 is a perspective view of the housing A, and terminal fastener B in FIG. 1, and a terminal C, showing a longitudinal cross section of a terminal chamber of the housing A.

FIG. 1 shows a male housing A and a terminal fastener B, both of which are made of synthetic resin. FIG. 2 is a perspective view of the housing A, the terminal fastener B in FIG. 1, and a terminal C, showing a longitudinal cross section of a terminal chamber 6. The terminal fastener B is inserted in the direction D as shown in FIG. 2 into a cavity 12 opening to the outer surface of a lower wall 4*b* of the housing A. Upon completion of assembly of the terminal fastener B into the housing A, the housing A is fitted to a mating female housing not shown. Referring to FIG. 2, an elongated female terminal C has an electrical contact C1 at a forward end thereof, a electrically crimping portion C2, and a wire crimping portion C3 at a rear end thereof. The terminal C is crimped at the portion C2 to a wire W electrical connection thereto and is mechanically crimped at C3 for mechanical strength. The electrical contact C1 is in the form of a receptacle that receives a mating tab of the mating connector (not shown). The female terminal C is formed with an engagement hole 2 in a base 1 thereof and pair of opposing engagement straps 8 with the engagement hole 2 therebetween. The housing A is formed with an upper row and a lower row of elongated terminal chambers therein between the upper and lower outer walls 4*a* and 4*b*. The elongated terminal chamber 6 opens at two opposite ends thereof, i.e., a front end and a rear end. Each terminal chamber is partitioned off adjacent chambers by means of walls 6*a*. The terminal C is inserted from the rear opening into the chamber 6. A fastening arm 8 extends from an inner wall of the terminal chamber 6 into the chamber 6 in the same direction as the terminal C is inserted into the chamber 6. The resilient fastening arm 8 has at a first end thereof an engagement projection 8*a* that engages the engagement hole 2 of the terminal C, and at a second end thereof a rear projection 9. The elongated resilient fastening arm 8 is supported at an intermediate portion thereof by a support portion 7 on the inner wall of the terminal chamber 6. The housing A is formed with a cavity 12 that extends through the row of the terminal chambers 6 as shown in FIGS. 1 and 2. The cavity 12 has an opening 11 that is defined by a front edge 11*a* and a rear edge 11*b* and opens to the outer surface of the wall 4*b*.

The outer wall 4*b* and middle partition 5 have a plurality of supporting walls 33 which project into the cavity 12 to define the slits 13 therebetween. The support portions 7 for the upper row of terminal chamber 6 project from the underside of the supporting walls 33 of outer wall 4*b* into the chambers 6. Likewise, the support portions for the lower row of terminal chambers 6 project from the underside of the middle partition 5 into the terminal chambers of the lower row. Vertically extending spaces 14 are formed adjacent each end of the upper and lower rows of terminal chambers 6. The spaces 14 receive fitting walls 19 of the terminal fastener B when the terminal fastener B is fitted into the housing A. The space 14 has a back wall 14*a* through which a lateral hole 15 communicates. The lateral hole 15 receives a hook 25*b* therein upon completion of the assembling the terminal fastener B into the housing A. The outer side walls 4*c* and 4*d* have projections 18, as shown in FIG. 6, which engage fastening recess 23 of the terminal fastener B when the terminal fastener B advances into the housing A as shown in FIG. 6. A locking arm 26 of the housing A engages a mating housing not shown, in locking relation, when the female housing A is inserted into the mating housing.

The terminal fastener B has an upper plate 17 and a lower plate 17′, which are in parallel to each other and oppose each other. The upper plate 17 has a plurality of projections 17*b* that closely fit into the slits 13 of the housing A to completely close the opening 11 when the terminal fastener B is fitted into the cavity 12 of the housing A. The upper plate 17 is formed with stepped engagement ends 20 and 21 thereon between the projections 17*b*. The lower plate 17′ is tapered for the following reasons.

Figure 3:
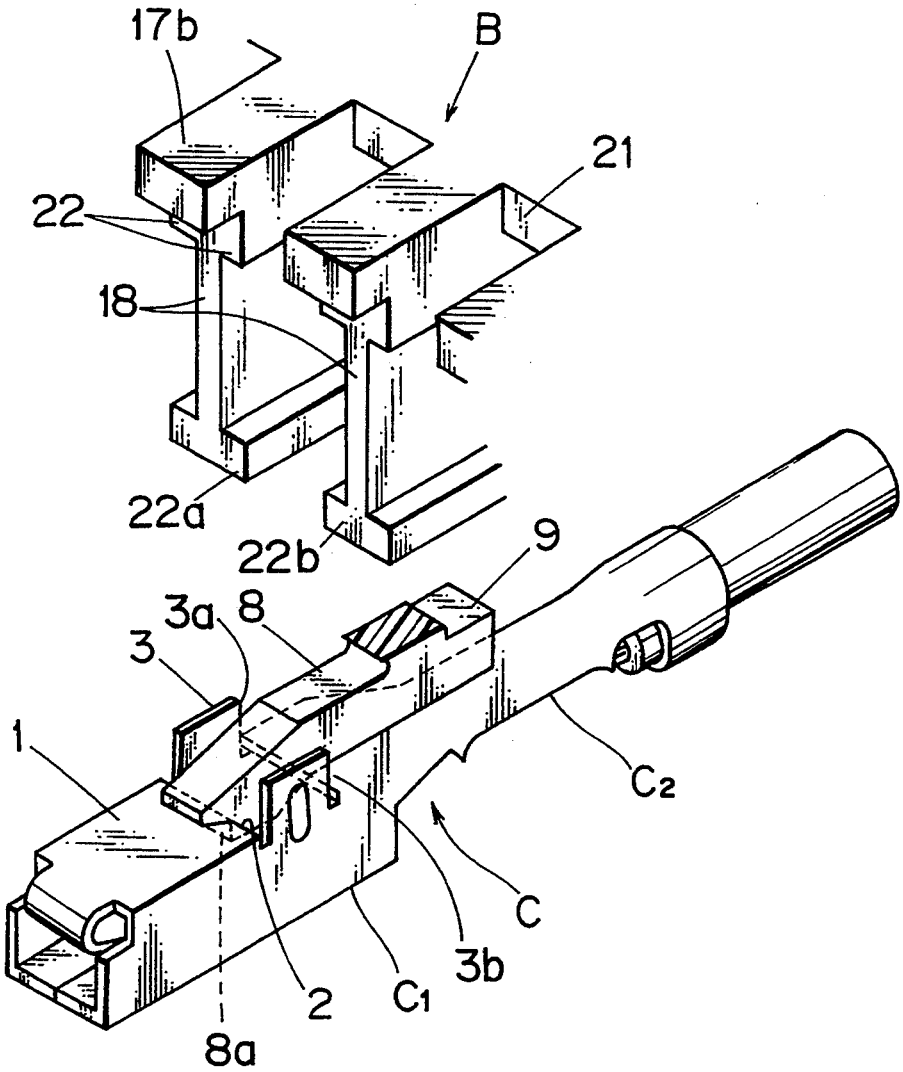
FIG. 3 is an expanded perspective view of the essential part of the terminal fastener B and terminal C with an engagement hole 2 thereof engaging the resilient terminal-fastening arm 8.

Between the upper and lower plates 17 and 17′ is formed a row of walls 18 which are spaced at predetermined intervals so as to divide the upper half of the cavity 12 to define the upper individual terminal chambers 6 when the terminal fastener B is fitted into the housing A. Each wall 18 has engagement ends 22 at an upper end thereof and a lower end thereof as shown in FIG. 3. Some walls in-the middle of the row of walls 18 have no engagement ends 22 since no terminal chambers are formed in the lower row behind the locking arm 26. When the terminal fastener B is inserted through the cavity 12 of the housing A into the permanent fastening position, the stepped engagement ends 20 and 21 engage the supporting wall 33 and the rear projections 9 of the resilient fastening arm 8, respectively, to firmly hold the resilient fastening arm 8 while at the same time, the engagement ends 22 engage the engagement straps 3 at 3*a* and 3*b*. Thus, the terminals are fastened in the housing with two fastening means; the fastening arm 8 engaging the hole 2 and the engagement end 22 engaging the engagement straps 3. This construction ensures a sure holding of the terminal C within the terminal chamber as well as prevents the terminals C from accidentally dropping out of the terminal chamber when tensile forces are exerted on the wires W connected to the terminals C.

The terminal fastener B has fastening recesses 23 adjacent the fitting walls 19 on the left and right ends of the terminal fastener B. Adjacent the fitting walls 19 is formed a space 24 into which a resilient arm 25 deflects when the terminal fastener B is advanced toward the permanent fastening position shown in FIG. 6B.

Figure 5A:
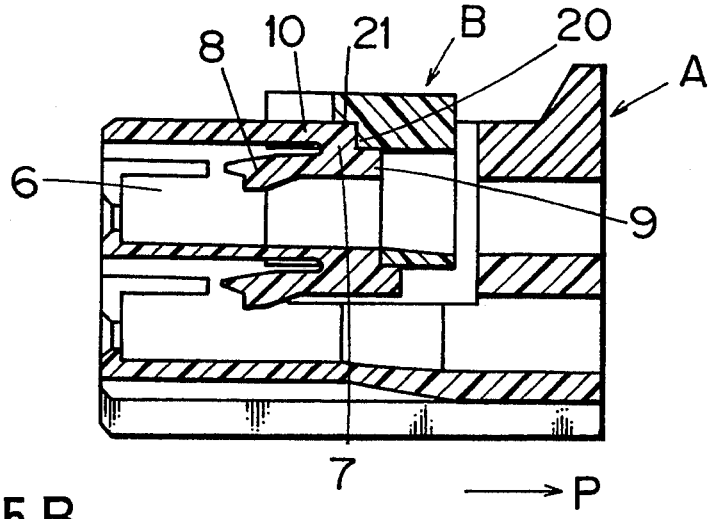
FIGS. 5A–5C sectional views illustrating the steps of fastening operation of the connector of the invention, FIG. 5A showing the connector at temporary fastening position, FIG. 5B showing the terminal fastener B moved in the direction of P from the position in FIG. 5A, and FIG. 5C showing the terminal fastener B in the permanent fastening position.
Figure 6A:
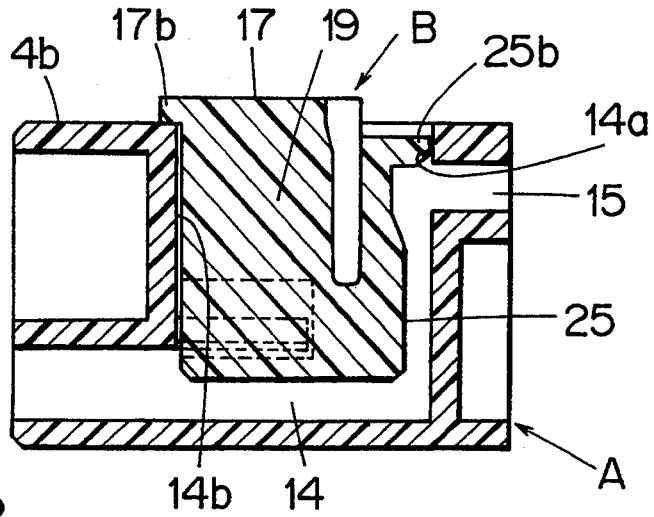
FIGS. 6A–6C are cross-sectional views illustrating the steps of fastening operation of a resilient arm 25 of the terminal fastener B corresponding to FIGS. 5A–5C, FIG. 6A showing the connector at temporary fastening position, FIG. 6B showing the terminal fastener B moved in the direction of P from the position in FIG. 6A, and FIG. 6C showing the terminal fastener B in the permanent fastening position.

FIGS. 5A and 6A show the terminal fastener B at the temporary fastening position. When the fastener B is inserted from above the cavity 12, front end 19*a* of the fitting wall 19 moves into contact with a front wall 14*b* while at the same time the hook 25*b* advances into the cavity 12 with the tip end thereof in contact with the back wall 14*a*. When the terminal fastener B is further inserted into the housing until the fastening recess 23 moves into engagement with the projection 16 of the housing A and the projections 17*b* abut the outer wall 4*b*, the terminal fastener B is temporarily fitted to the housing A.

Figure 4:
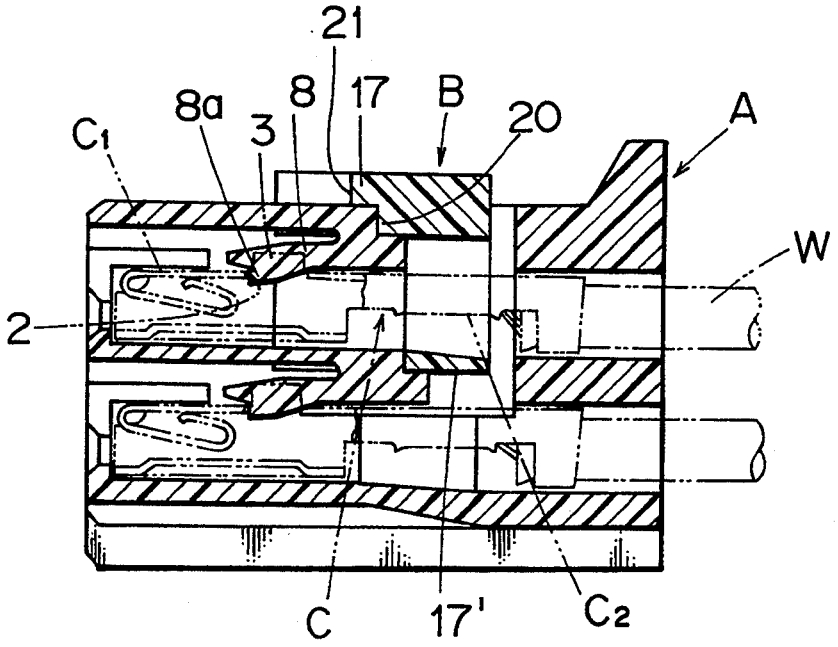
FIG. 4 is a cross section of the connector of the present invention when the terminal fastener B is inserted into the temporary fastening position and the terminals C are inserted into the terminal chambers.

With the terminal fastener B positioned at the above-described temporary fastening position, the female terminal C is inserted from the rear opening of the terminal chamber 8, so that the terminal C engages at the hole 2 the tip end 8*a* of fastening arm 8 as shown in FIGS. 3 and 4. It should be noted that the lower plate 17′ is tapered to help the terminal C slide upward for further insertion into the terminal chamber 6 when inserted into the housing. At this time, the stepped engagement end 20 abuts both the rear projection 9 of fastening arm 8 and the supporting wall 33, holding them firmly as shown in FIG. 5A so that the terminal fastener B is positioned in position relative to the housing A. Firmly holding the rear projection 9 prevents the fastening arm 8 from deflecting about the support portion 7 when an external force is exerted on the tip 8*a* of the fastening arm 8 via the wire W crimped to the terminal C. In this manner, the terminal C is prevented from moving out of engagement with the fastening arm 8. This structure ensures the ability of the fastening arm 8 to hold the terminal C as well as prevent damages to the support portion 7 due to a bending moment exerted thereon.

Figure 5B:
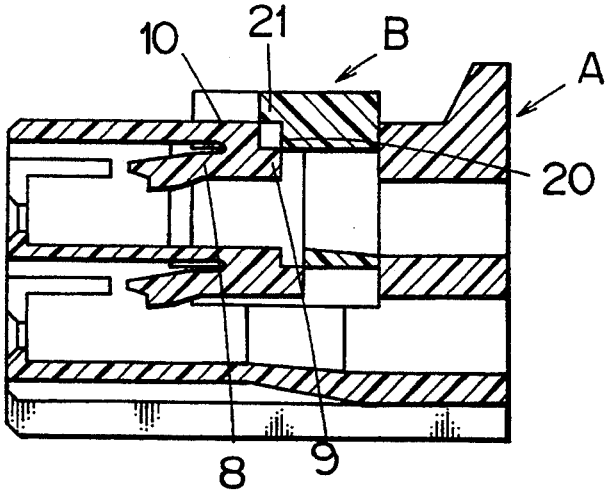
Figure 5C:
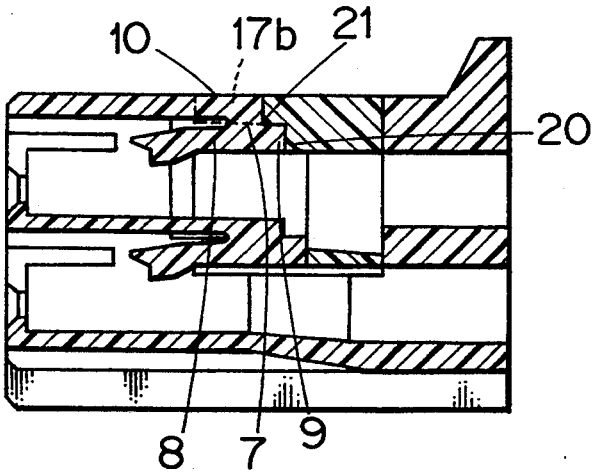
Figure 6B:
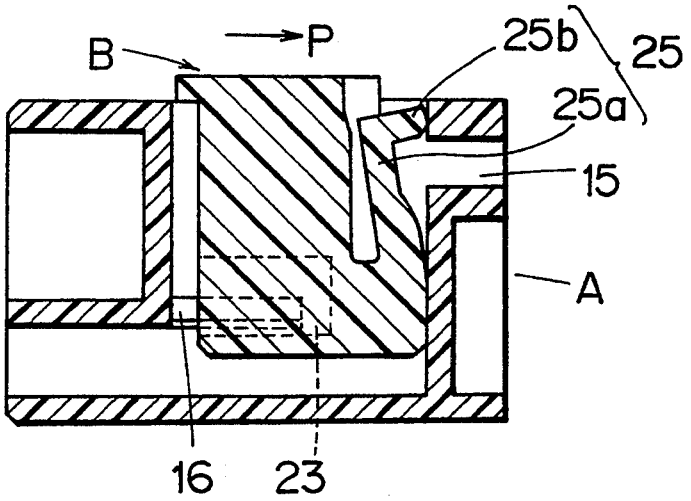
Figure 6C:
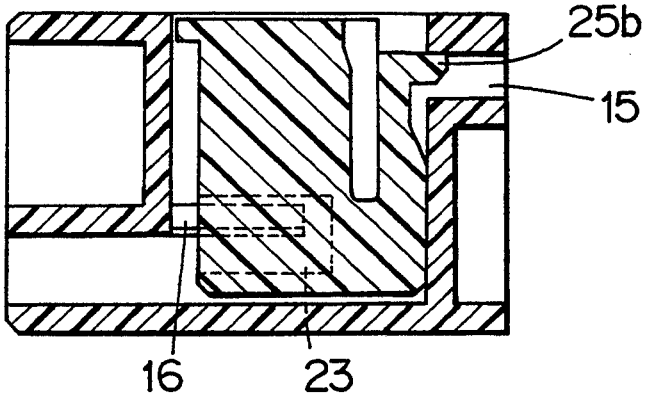
Figure 7A:
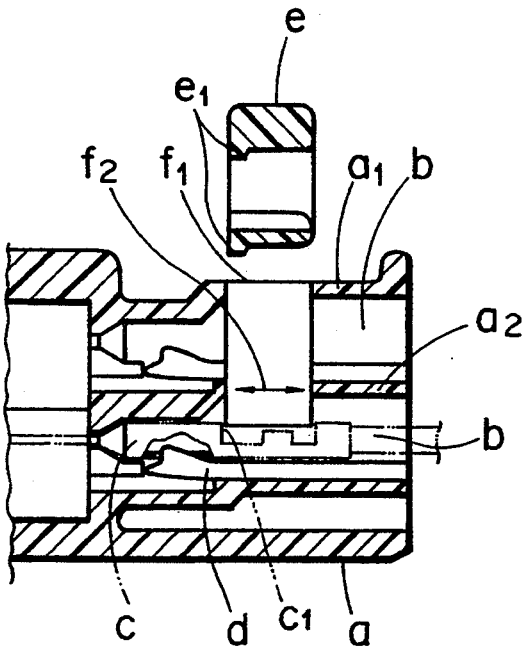
FIG. 7A PRIOR ART
FIG. 7A shows a cross sectional side view of the terminal fastener e and the housing a of a prior art connector before the terminal fastener is fitted into the housing.
Figure 7B:
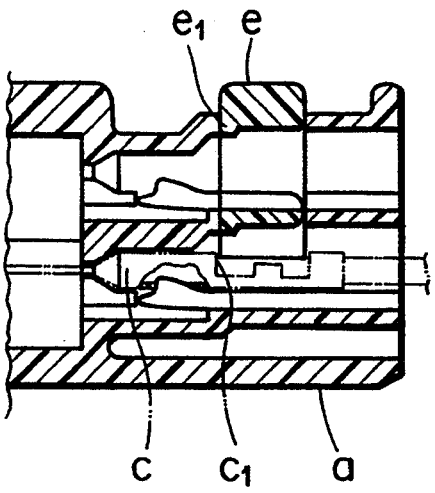
FIG. 7B PRIOR ART
FIG. 7B shows the terminal fastener e being inserted into the housing a of the prior art connector of FIG. 7A.
Figure 8A:
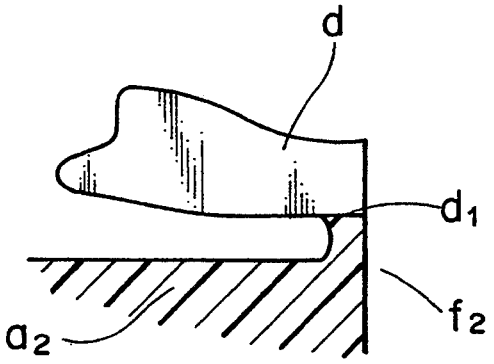
FIG. 8A PRIOR ART
FIGS. 8A–8B are expanded side views with cross-sectional view in part, illustrating the deflection of a resilient fastening arm d of FIG. 7.
Figure 8B:
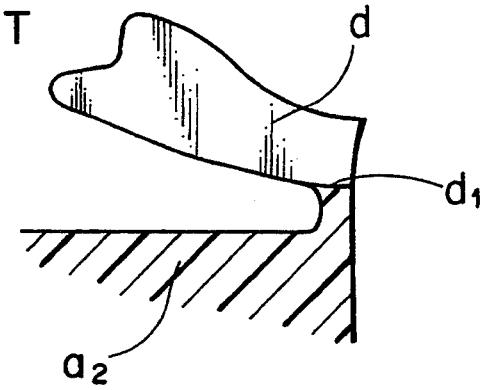
FIG. 8B PRIOR ART

After insertion of the female terminals C has been completed in the temporary fastening position, the terminal fastener B is further advanced in the direction of P into the cavity 12 as shown in FIGS. 5B and 6B while also being moved against the force exerted by the resilient arm 25. Thus, as shown in FIGS. 5C and 6C, the resilient arm 25 is permanently fastened when the hook **25*b* drops into the lateral hole 15. At this time, the engagement ends 22 of terminal fastener B engage the engagement straps 3 of the terminal C. Thus, the terminal C is fastened by two fastening means; one is the fastening arm 8 engaging the hole 2 and the other is the engagement end 22 engaging the straps 3. The stepped engagement ends 20 and 21 engage the rear projection 9 and the supporting walls 33, respectively, in fitting relation to firmly hold the fastening arm 8. The terminal fastener B helps the fastening arm 8 hold the terminal C more firmly in the permanent fastening position in FIGS. 5C and 6C than in the temporary fastening position in FIGS. 5A and 6A**.

Although the invention has been described with respect to an embodiment where the fastening arm 8 engages the hole 2 as shown in FIG. 3, the hole 2 and straps 3 may be provided on the other side of the terminal C, opposite to the position in FIG. 3. The straps 3 may also be provided on the portion C2 rather than on the portion C1, in which case, the engagement end 22 is of course formed at a corresponding position. A resilient arm similar to the resilient arm 25 may be provided in the space 14 and the resilient arm 25 on the terminal fastener B may be replaced by a lateral hole similar to the hole 15, so that the resilient arm in the space 14 engages the lateral hole in the terminal fastener B.

What is claimed is:

1. A connector having a dual terminal-fastening structure, comprising:

at least one terminal having an engagement hole and two engagement straps disposed adjacent to and on opposite sides of said engagement hole;

a housing having a terminal chamber therein for housing the terminal inserted into the housing;

a support portion projecting from a wall of the terminal chamber into the terminal chamber;

an elongated resilient engagement arm having a first end portion and a second end portion which engages said engagement hole of the terminal to hold the terminal within the terminal chamber, said arm being supported at an intermediate portion thereof on said support portion and extending within the chamber in a direction in which the terminal is inserted into the housing;

a terminal-fastener fitted into said housing for fastening the terminal in place within the terminal chamber, said terminal-fastener being first moved to a temporary fastening position and then to a permanent fastening position;

a plurality of first engagement portions being disposed on said terminal-fastener, two of said plurality of first engagement portions respectively engaging said two engagement straps of the terminal to fasten said terminal within the terminal chamber when said terminal-fastener is fitted into said housing; and a second engagement portion provided on said terminal-fastener for engaging an outer surface of the wall of the terminal chamber and the support portion when the terminal retainer is in a temporary fastening position, and for engaging the support portion and the first end portion when said terminal fastener is fitted into said housing, thereby preventing the resilient arm from being deformed when a force is exerted on the resilient arm in the direction opposite to the direction in which the terminal is inserted.

2. A connector according to claim 1, wherein said two engagement straps of the terminal are aligned in a direction transverse to the direction in which said terminal is inserted into the housing, said two engagement straps receiving said resilient engagement arm therebetween, such that said terminal is guided by said resilient engagement arm as the terminal advances into the chamber when the terminal is inserted into the housing.

3. A connector according to claim 1, wherein said first engagement portion engages said two engagement straps so as to prevent a movement of the terminal in a direction opposite to the direction in which the terminal is inserted.

4. A connector according to claim 1, wherein said housing has a plurality of aligned terminal chambers, and said terminal-fastener has a plurality of aligned first engagement portions and a plurality of aligned second engagement portions, each of the terminal chambers corresponding to one of said first engagement portions and to one of said second engagement portions.

5. A connector having a dual terminal-fastening structure, comprising:

at least one terminal having an engagement hole and an engagement strap;

a housing having a terminal chamber therein for housing the terminal inserted into the housing, said housing having a vertically extending space open from one surface of said housing, and a lateral hole in said housing extending transversely from an intermediate portion of said vertically extending space;

a support portion projecting from a wall of the terminal chamber into the terminal chamber;

an elongated resilient engagement arm having a first end portion and a second end portion which engages said engagement hole of the terminal to hold the terminal within the terminal chamber, said arm being supported at an intermediate portion thereof on said support portion and extending within the chamber in a direction in which the terminal is inserted into the housing;

a terminal-fastener fitted into said housing for fastening the terminal in place within the terminal chamber, said terminal-fastener being first moved to a temporary fastening position and then to a permanent fastening position, said terminal-fastener having an end portion insertable into said vertically extending space, said end portion including a resilient arm having a hook member which is engageable with said lateral hole in said housing, so that in an assembled condition of said terminal fastener with said housing, said resilient arm urges said hook member into said lateral hole to retain said terminal fastener in said housing;

a first engagement portion provided on said terminal-fastener for engaging said engagement strap of the terminal to fasten said terminal within the terminal chamber when said terminal-fastener is fitted into said housing; and a second engagement portion provided on said terminal-fastener for engaging an outer surface of the wall of the terminal chamber and the support portion when the terminal retainer is in a temporary fastening position, and for engaging the support portion and the first end portion when said terminal fastener is fitted into said housing, thereby preventing the resilient arm from being deformed when a force is exerted on the resilient arm in the direction opposite to the direction in which the terminal is inserted.

6. A connector according to claim 5, wherein said engagement strap of the terminal includes two straps aligned in a direction transverse to the direction in which said terminal is inserted into the housing, said two straps receiving said resilient engagement arm therebetween, such that said terminal is guided by said resilient engagement arm as the terminal advances into the chamber when the terminal is inserted into the housing.

7. A connector according to claim 5, wherein said first engagement portion engages said engagement straps so as to prevent a movement of the terminal in a direction opposite to the direction in which the terminal is inserted.

8. A connector according to claim 5, wherein said housing has a plurality of aligned terminal chambers, and said terminal-fastener has a plurality of aligned first engagement portions and a plurality of aligned second engagement portions, each of the terminal chambers corresponding to one of said first engagement portions and to one of said second engagement portions.

* * * * *